United States Patent [19]

Davies et al.

[11] 3,993,217

[45] Nov. 23, 1976

[54] CIGARETTE HOPPERS

[75] Inventors: Robert William Davies; Peter Ernest Willett, both of London, England

[73] Assignee: Molins Limited, London, England

[22] Filed: Sept. 3, 1975

[21] Appl. No.: 610,017

[30] Foreign Application Priority Data

Aug. 28, 1975 United Kingdom ..... 35485/75

[52] U.S. Cl. ..... 221/93; 221/238; 53/151

[51] Int. Cl.[2] ..... B65H 3/40

[58] Field of Search ..... 53/151; 221/131, 93, 221/270, 200, 202, 238

[56] References Cited

UNITED STATES PATENTS

| | | | |
|---|---|---|---|
| 1,292,619 | 1/1919 | Lorenz | 221/270 X |
| 1,769,650 | 7/1930 | Rose | 53/151 |
| 2,682,983 | 7/1954 | Ashcroft | 53/151 |

*Primary Examiner*—Stanley H. Tollberg
*Attorney, Agent, or Firm*—John C. Smith, Jr.

[57] ABSTRACT

A hopper for a cigarette-packing machine has a number of vertical channels each accommodating a single column of cigarettes, with their axes horizontal. Plungers reciprocating across the lower ends of the channels remove a selected number of cigarettes from each channel during each forward stroke. During each return stroke of the plungers, vanes interdigitated with the plungers support the cigarettes in the channels above the plungers, said vanes lowering before the next forward stroke of the plungers to control descent of the cigarettes on to a base plate.

To allow faster operation of the hopper without increasing the speed of vane lowering so that cigarette descent is not sufficiently controlled, the plungers are pivotally mounted to permit them to be downwardly inclined during their return stroke and then allow vane lowering to begin earlier in each operating cycle. The base plate may also be pivotally mounted, and downwardly inclined during the plungers' return stroke to increase the angle of inclination possible for the plungers.

8 Claims, 6 Drawing Figures

CIGARETTE HOPPERS

This invention relates to hoppers for cigarette-packing machines. In such machines, it is common practice to form a "bundle" of cigarettes, comprising the required number of cigarettes assembled in rows so as to fit a selected form of packet, and then to place the bundle in a packet, e.g. by assembling the bundle with one or more blanks which is or are folded around the bundle to make the packet. By the term "hopper" we mean that part of such a machine which receives a bulk supply of cigarettes and arranges them in groups each containing the correct number of cigarettes, suitably aligned and disposed according to the form of packet in which they are to be enclosed.

More specifically, the invention relates to that type of hopper in which a bulk supply of cigarettes is guided into a plurality of vertical channels, each accommodating a single column of cigarettes with their axes horizontal, across the lower ends of which channels a set of plungers reciprocate horizontally so as to remove a selected number (corresponding to the height of each plunger) from each channel for each forward stroke of said set of plungers. It will be appreciated that the plungers must have a horizontal stroke at least equal to the length of the cigarettes, and in practice somewhat longer. When the plungers return, the cigarettes in the vertical channels must descend on to a base plate before the plungers make their next forward stroke. To ensure that only the correct number of cigarettes from each channel are moved by each plunger stroke, a suitably-sized transfer opening is provided at the side of the vertical channels through which the cigarettes are pushed by the plungers, and the cigarettes must descend on to the base plate, without becoming disordered or bouncing, between the completion of a return stroke and initiation of the next forward stroke of the plungers. This means that the descent of the cigarettes must be a controlled descent; and for this purpose a set of lowering vanes is provided, interdigitated with the plungers; these vanes support the cigarettes in the channels above the level of the plungers while the latter execute each return stroke and then descend to lower the cigarettes until the lowest cigarettes rest on the base plate. The plungers then execute a forward stroke, the vanes rising during the latter part of such stroke so as to be in cigarette-supporting position before the plungers return.

The vanes cannot of course begin to rise until the cigarettes being moved by the plungers are clear of the path of the vanes; the vanes do not extend over the whole length of the cigarettes so that ascent of the vanes can begin sufficiently before the plungers complete their forward stroke. The descent of the vanes must be as rapid as possible, as the plungers must stay clear of the bottom of the channels until such descent is complete, and the speed of vane descent is therefore a significant factor in the maximum speed of operation of such a hopper. However, there is a natural limit on the speed of descent of the vanes; if the downward acceleration of the vanes at any instant exceeds the acceleration due to gravity, the cigarettes cease to be supported by the vanes and are free to become misaligned; if they are falling unsupported when they reach the base plate, they may bounce so as to be misaligned when the plungers move forward and so be trapped between the plungers and walls bounding the transfer opening. The descent of the vanes is accordingly timed, usually by a cam drive to the vanes, to avoid excessive downward acceleration, and even with the fastest possible execution of the rest of the operating cycle there is a limit to the permissible operating speed of the hopper.

It is an object of the present invention to provide a hopper of the type above defined in which higher speeds of operation then hitherto may be employed, while maintaining adequate control of the cigarettes' descent by the lowering vanes.

According to the invention we provide a hopper for a cigarette packing machine comprising a plurality of vertical cigarette-guiding channels, a set of horizontally-reciprocable plungers arranged to move across the lower ends of the said channels to feed a selected number of cigarettes from each channel, and a set of lowering vanes interdigitated with said plungers to support cigarettes in said channels during each return stroke of the plungers and permit controlled descent of cigarettes on to a base plate between each return stroke and the following forward stroke of the plungers, in which the plungers are each mounted for pivotal movement about a horizontal axis, and drive means being provided to incline the plungers downwardly during each return stroke of the plungers.

While an appreciable advantage is obtained by inclination of the plungers only, the base plate limits the plunger inclination which can be effected. However, if desired operating conditions are such as to require a greater plunger inclination the base plate (or a part of it) may also be pivotally mounted and the drive means may be arranged to cause the base plate (or such part) also to be inclined during the return stroke of the plungers.

In a hopper embodying the invention, the downward inclination of the plungers during the plungers' return stroke permits lowering of the cigarettes, supported by the vanes, to commence during such return stroke without risk of undesired contact between the lowest cigarette and the plungers while the latter are returning. Thus the lowering of the vanes may occupy a larger proportion of each cycle of operation of the vanes than in prior forms of hopper and therefore, without exceeding the maximum permissible level of downward acceleration of the vanes, the cycle time may be shorter then heretofore i.e. the speed of the hopper in terms of cycles (and hence groups of cigarettes delivered) per unit time may be higher. For example, in the established form of "hinge-lid" cigarette packer manufactured by applicants, it has been found that use of the invention permits the vane lowering time to be increased from 84° to 140° of the cycle, and this change allows the hopper speed to be increased by some 50%, e.g. from 120 to 180 cigarette groups per minute.

It is preferred in a hopper embodying the invention to use conjugate cams (i.e. cams providing positive drive in both directions) to produce the movements of the reciprocating or oscillating parts, as the speed increase attained makes positive drive and exact positioning of the moving parts more critical than hitherto.

In order that the invention may be well understood, a preferred embodiment thereof will now be described, with reference to the accompanying drawings, in which.

Figure 1:
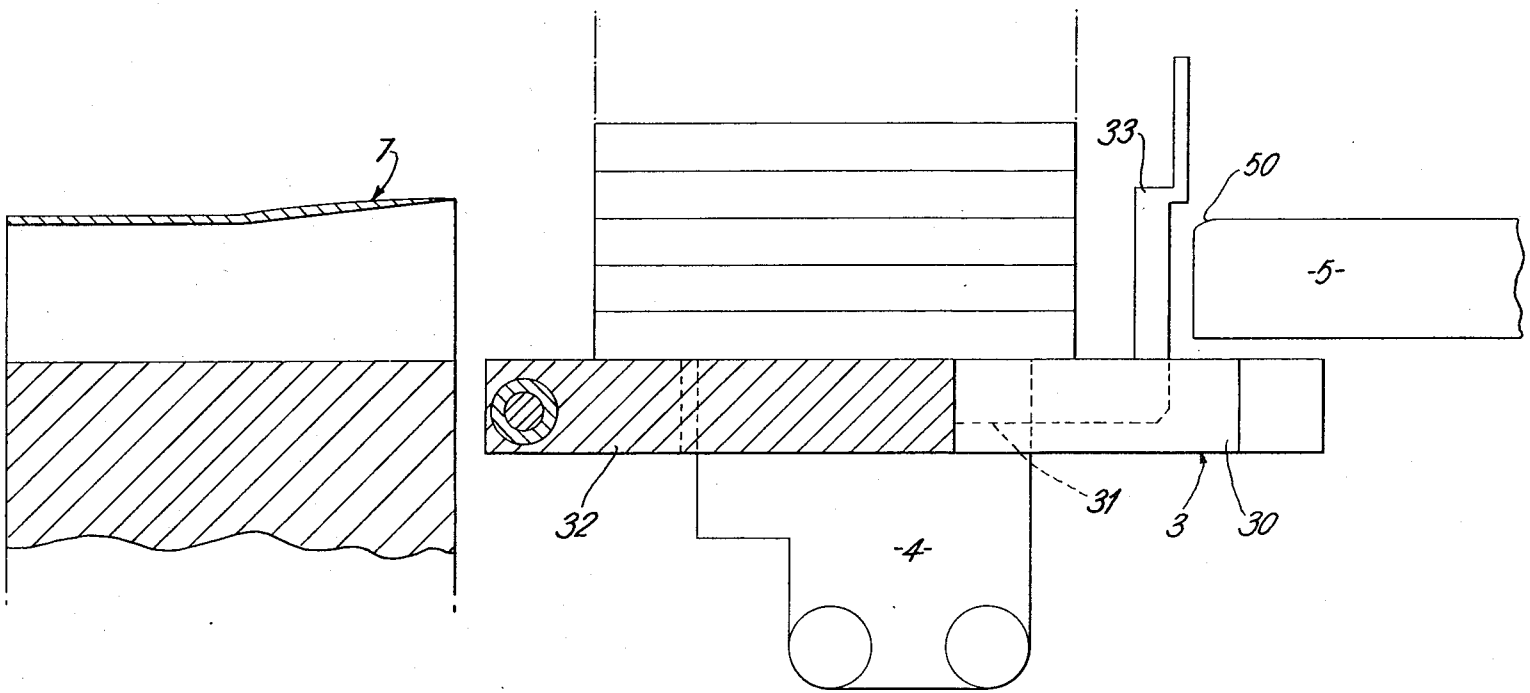
FIG. 1 is a side view of a hopper for a cigarette-packing machine.

FIGS. 3 – 6 inclusive are views similar to FIG. 1, but showing different stages of operation. Unreferenced arrows in these Figures indicate motion of the parts on which they appear.

Figure 2:
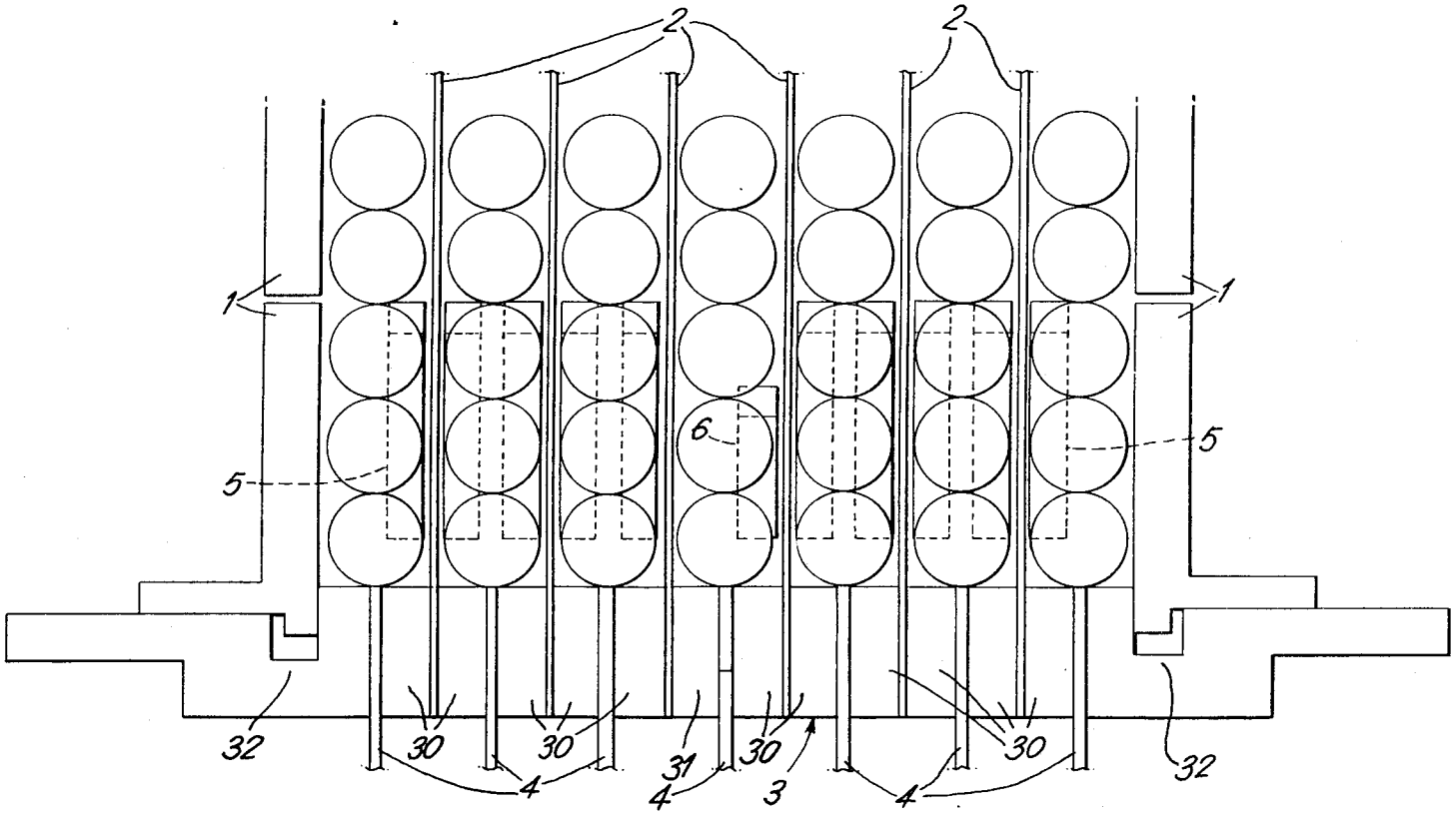
FIG. 2 is an end view of part of the hopper of FIG. 1.

Referring first to FIGS. 1 and 2, the hopper shown has seven vertical cigarette channels defined by outer walls 1 and internal partitions 2. The channels are closed at the bottom by a base-plate 3, which is slotted to receive the partitions 2 and also to accommodate seven vertically-reciprocable vanes 4 disposed in alignment with the centres of the seven channels (FIG. 2).

Horizontally-reciprocable plungers 5, 6 are disposed just above the level of the upper surface of base-plate 3, and when the hopper is operating said plungers 5, 6 repeatedly move from right to left (as seen in FIG. 1) to push cigarettes from the bottom of each channel into a receiving pocket 7 for further processing not relevant to the present description. Plungers 5, operating in all the channels but the central one, are of such height that each plunger engages, and propels towards the pocket 7, three cigarettes. The plunger 6, operating in the central channel, is of such height as to engage only two cigarettes, thus when all seven plungers operate, a total of twenty cigarettes are propelled into the pocket 7.

Figure 3:
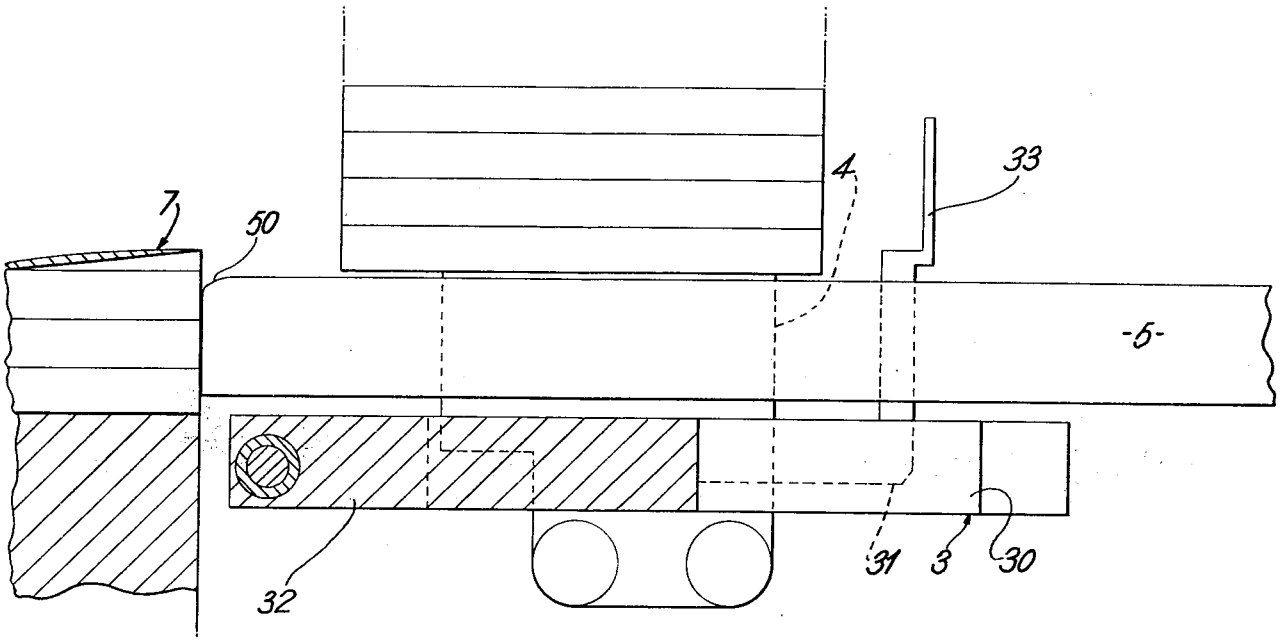
Figure 4:
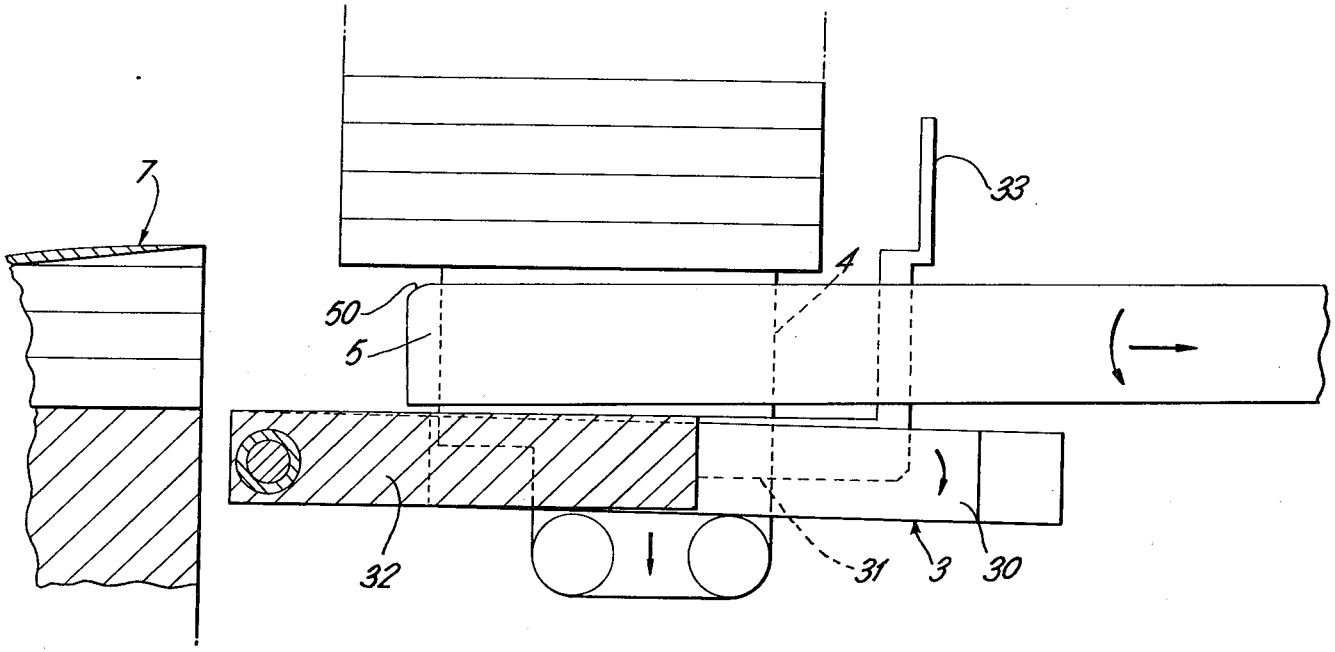

As the plungers 5 complete each forward stroke towards pocket 7, vanes 4 rise between said plungers to engage the lowest cigarette remaining in each channel as shown in FIG. 3, and support the cigarettes above the plungers as the latter return. It will be seen then the vanes 4 do not extend the full length of a cigarette and the vanes can therefore rise during the latter part of the forward stroke of plungers 5, the rise commencing as soon as the cigarettes being pushed by the plungers are clear of the path of the vanes. FIG. 4 shows the vanes in their fully raised position, with plungers 5 in the course of their return stroke.

Figure 5:
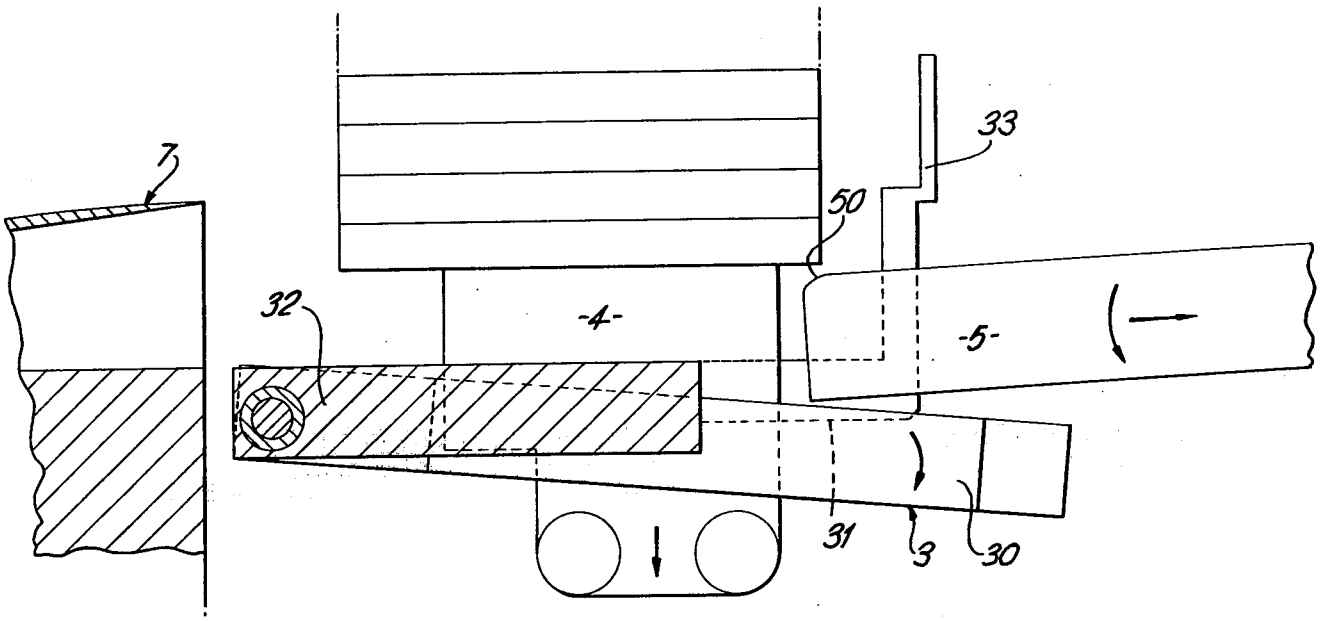
Figure 6:
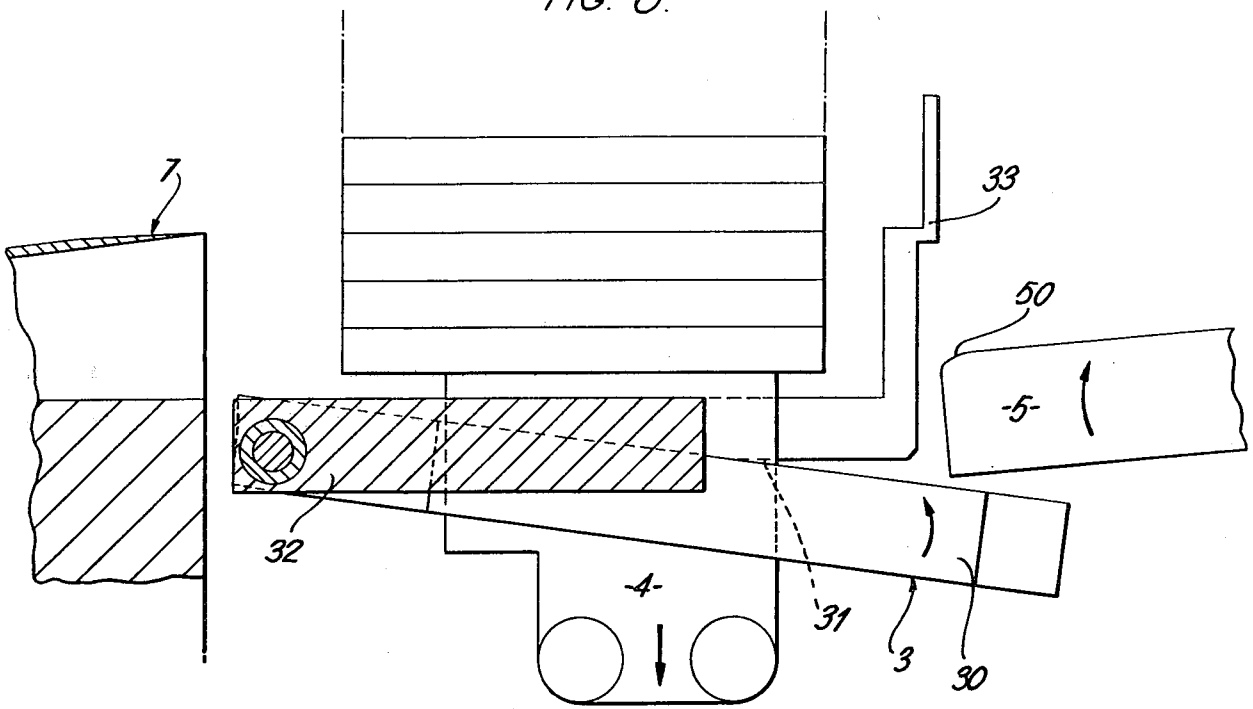

Plungers 5 are pivotally mounted at their right-hand (as seen in FIG. 1) ends, and base-plate 3 is pivotally mounted at its left-hand end. As the plungers return to the right, both the plungers 5 and base-plate 3 are inclined downwardly; successive stages of inclination are shown in FIGS. 4, 5 and 6. As seen in FIG. 4 this inclination has just commenced, but in FIG. 5 both the plungers and the base plate are considerably inclined and downward movement of vanes 4 has commenced, this latter being possible, although plungers 5 are not clear of the channels, due to the downward displacement of the left-hand ends of plungers 5 which is in turn permitted by the downward displacement of the adjacent part of base-plate 3.

As seen in FIG. 6, the plungers 5 have just completed their return stroke and are fully clear of the channels, the vanes 4 are about one-half a cigarette diameter from their lowest position, and the plungers 5 and base-plate 3 are just beginning to pivot upwardly to resume their horizontal positions. This return must be completed no later than the time when vanes 4 reach their lowest positions, as the baseplate 3 must be horizontal to receive the descending cigarette. It will be appreciated that the inclination of the plungers 5 and base-plate 3 enables lowering of the vanes 4 to commence much earlier in the cycle of operation than would be possible if, as in prior hoppers, the plungers and base-plate remained horizontal. To assist at one of the points of minimum clearance at certain stages of operation, the upper corner of each plunger 5, 6 at its cigarette-engaging (lefthand) end is slightly radiused as seen at 50 in FIG. 1.

The pivotally-mounted base-plate 3 includes those portions indicated by reference 30 in FIG. 2. The members 31, 32 are not part of the base-plate 3 but are fixed, members 32 being at the outside of the assembly and member 31 being below one-half of the central channel. From this central channel only two cigarettes are removed upon each forward stroke of the associated plunger 6, hence the remaining cigarettes have less distance to descend to the base-plate and complete their descent earlier than the cigarettes in the remaining channels, at which time fixed member 31 stops them in correct horizontal position even if base-plate 3 has not fully returned to the horizontal. A bracket 33 (FIG. 1) formed as an extension of member 31 helps to support the latter, the upper end of said bracket being secured to a fixed part of the hopper (not shown).

Above the fixed members 31, 32 no plungers are provided as the presence of the fixed members would prevent downward inclination of such plungers. Thus the two outer channels (FIG. 2) each have only one plunger 5, and the central channel has only a single plunger 6, although the remaining channels have each two plungers 5. This arrangement of plungers is sufficient; it is pertinent here to note that, as the cigarettes are propelled into the pocket 7, they are guided laterally to occupy minimum width as compared with their spaced disposition in the vertical channels (FIG. 2) so that if two plungers were provided in each outer channel the additional plungers would not in fact be of much effect except perhaps in the beginning of their forward stroke.

While the arrangement illustrated, with provision for downward inclination of both the plungers and the base-plate offers maximum possibility of increased speed as compared with prior hoppers, it is possible to obtain a useful speed increase with a fixed base-plate, the plungers only being inclined during their return stroke to the angle permitted by their spacing from the base-plate.

Any convenient arrangement may be provided for moving the plungers to their inclined position and returning them to the horizontal, but we prefer to employ conjugate cams as a positive drive in both directions is desirable in view of the speeds and small clearances involved.

We claim:

1. In a hopper for a cigarette-packing machine comprising a plurality of vertical cigarette-guiding channels, a set of horizontally-reciprocable plungers arranged to move across the lower ends of said channels to feed a selected number of cigarettes from each channel, a horizontal base plate extending across said channels below said plungers, and a set of lowering vanes interdigitated with said plungers to support cigarettes in said channels during each return stroke of the plungers and permit controlled descent of cigarettes on to said base plate between each return stoke and the following forward stroke of the plungers, the improvement comprising a pivotal mounting for each of said plungers, said pivotal mountings having a horizontal pivot axis to permit the plungers to be inclined downwardly during each return stroke of the plungers.

2. In a hopper as claimed in claim 1, a pivotal mounting for said base plate, whereby the base plate also may be inclined downwardly during the return stroke of the plungers.

3. In a hopper as claimed in claim 2, in which one of the plungers is arranged to feed a smaller number of cigarettes from its associated channel on each forward stroke than each of the remaining plungers, a fixed support being arranged below the channel associated with said one plunger, said fixed support lying below substantially one-half of the width of the channel and a part of the base-plate lying below substantially the remaining half of said width, said one plunger being arranged to move in a path above said part of the base-plate.

4. A hopper for a cigarette-packing machine comprising:

a. a plurality of vertical cigarette-guiding channels;

b. a plurality of plungers arranged for reciprocal movement along substantially horizontal paths across the lower ends of said channels, said plungers being adapted to make a forward stroke to feed a predetermined number of cigarettes from each channel and a return stroke during each cycle;

c. a substantially horizontal base plate in a plane extending across said channels below said paths of said plungers;

d. a plurality of lowering vanes interdigitated with said plungers and arranged during each cycle to move along substantially vertical paths upwardly to support cigarettes in said channels before said turn stroke of said plungers and downwardly to control descent of cigarettes towards said base plate during said return stroke of said plungers; and e. pivotal mountings for said plungers permitting the latter to incline downwardly from said substantially horizontal path to an inclined position during each return stroke of said plungers and upwardly from said inclined position to said substantially horizontal path before the next succeeding forward stroke of said plungers;

f. whereby said downward movement of cigarettes on said vanes occurs during said return stroke of said plungers without the lowermost cigarette in each channel contacting a plunger permitting faster operation of said hopper without increasing the rate of said downward movement of said vanes and consequent loss of control of cigarettes during their descent.

5. A hopper as claimed in claim 4 wherein the length of said vanes is less than the length of said strokes of said plungers whereby upward movement of said vanes begins as soon as the cigarettes being pushed by said plungers are clear of said substantially vertical paths of said vanes and before said plungers complete said forward stroke.

6. A hopper as claimed in claim 4 further comprising a pivotal mounting for said base plate permitting said plate to incline to a further inclined position during each return stroke of said plungers and upwardly from said further inclined position to said plane before the next succeeding forward stroke of said plungers, said inclined position of said plungers being lower than said plane of said base plate.

7. A hopper as claimed in claim 6 wherein said plungers and base plate are arranged to pivot about axes at opposite sides of said plurality of channels.

8. A hopper as claimed in claim 4 wherein at least one of said plungers is arranged to feed a smaller number of cigarettes from its associated channel during each forward stroke than each of the remaining plungers, said hopper further comprising a fixed support arranged below said channel associated with said one plunger, said fixed support lying below a part of the width of said channel, a part of said base plate lying below another part of the width of said channel, and said one plunger being arranged to move in a path above said part of said base plate.

* * * * *